US005662502A

United States Patent [19]

Allen et al.

[11] Patent Number: 5,662,502

[45] Date of Patent: Sep. 2, 1997

[54] ADAPTOR FOR AC CONNECTOR

[75] Inventors: John E. Allen, Winter Haven; Johnny L. Hackedy, Auburndale, both of Fla.

[73] Assignee: Term-Lok, Inc., Haines City, Fla.

[21] Appl. No.: 530,615

[22] Filed: Sep. 20, 1995

[51] Int. Cl.[6] ..... H01R 4/36

[52] U.S. Cl. ..... 439/814

[58] Field of Search ..... 439/810, 814, 439/346, 889; 310/71

[56] References Cited

U.S. PATENT DOCUMENTS 1,610,052 12/1926 Holmes ..... 439/814
2,526,937 10/1950 Cripe ..... 439/814

FOREIGN PATENT DOCUMENTS 6508724 1/1966 Netherlands ..... 439/814

*Primary Examiner*—Gary F. Paumen
*Attorney, Agent, or Firm*—James H. Beusse

[57] ABSTRACT

An electric power connection system for a hermetically sealed electric motor having a plurality of electric power terminals substantially encapsulated in an electrically insulative block with the terminals protruding about ⅜ inch from a surface of the block. A generally cylindrical tube of electrically conductive metallic material has at least one end with an inner diameter sized to admit one of the terminals in general sliding engagement with the tube. The tube further has a threaded aperture extending through a sidewall adjacent the at least one end with a set screw threadedly inserted in the threaded aperture and adapted for compressive engagement with the terminal for establishing retention and electrical continuity between the terminal and the tube. An electrical lead is connected to an end of the tube opposite the at least one and for coupling power to the terminal. Preferably, the lead is attached to the tube by crimping of the tube onto the lead.

12 Claims, 2 Drawing Sheets

ADAPTOR FOR AC CONNECTOR

BACKGROUND OF THE INVENTION

The present invention relates to air conditioning systems and, more particularly, to an apparatus and system of connection of electrical power to an electrical drive motor in such systems.

Air conditioning systems generally comprise an evaporator and blower located within an enclosure to be cooled, such as a building, and a compressor and blower located outside the enclosure. Typically, the compressor and its associated blower are exposed to the outside environment, including rain, dust and atmospheric contaminants. The compressor motor is commonly incorporated in the compressor and the entire compressor is hermetically sealed. Electrical power is supplied to the compressor by connection to several spade type male connectors protruding from an encapsulated block on the compressor. Each male connector typically comprises a round metal pin to which a flat metal plate is welded or brazed. The plate is sized to accept a conventional female wire end connector attached to a short piece of electrical wire.

During servicing of the air conditioning system, it is not unusual for a technician to remove the electrical connector from the compressor or to find that the connector has broken away from the compressor. In reconnecting the electrical power, the metal plate is often found to have deteriorated to such an extent that the conventional female connector will no longer attach to the spade type male connector. Technology for reattaching a metal plate to the metal pin without damaging the encapsulated block is not normally available thus requiring the technician to attempt various types of crimping arrangements to avoid replacing the compressor assembly. Accordingly, it is desirable to provide a system and apparatus for enabling electrical connection to damaged or deteriorated male connectors on an air conditioning compressor assembly.

SUMMARY OF THE INVENTION

Among the several objects of the present invention may be noted the provision of a system for connecting electrical power to a sealed motor and the provision of an improved female connector for connection of power to a pin-type male connector. In one form, the present invention comprises an electric power connection system including an electric motor having a hermetically sealed power terminals with ends of the terminals extending as pins from a block of encapsulation material. A mating connector is formed as a generally cylindrical tube of electrically conductive material, such as brass, the tube having an inner diameter at least greater than the outer diameter of the pins whereby an end of the tube can be slipped over a respective one of the pins. A threaded aperture is formed in the end of the tube extending transverse to an axis of the tube and a set screw inserted through the aperture and tightened against the male pin. A electrical lead is coupled to an opposite end of the tube, preferably by forming a hole through the tube transverse to the tube axis and inserting the lead through the hole. The lead is fixed to the tube by soldering or crimping of the tube.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
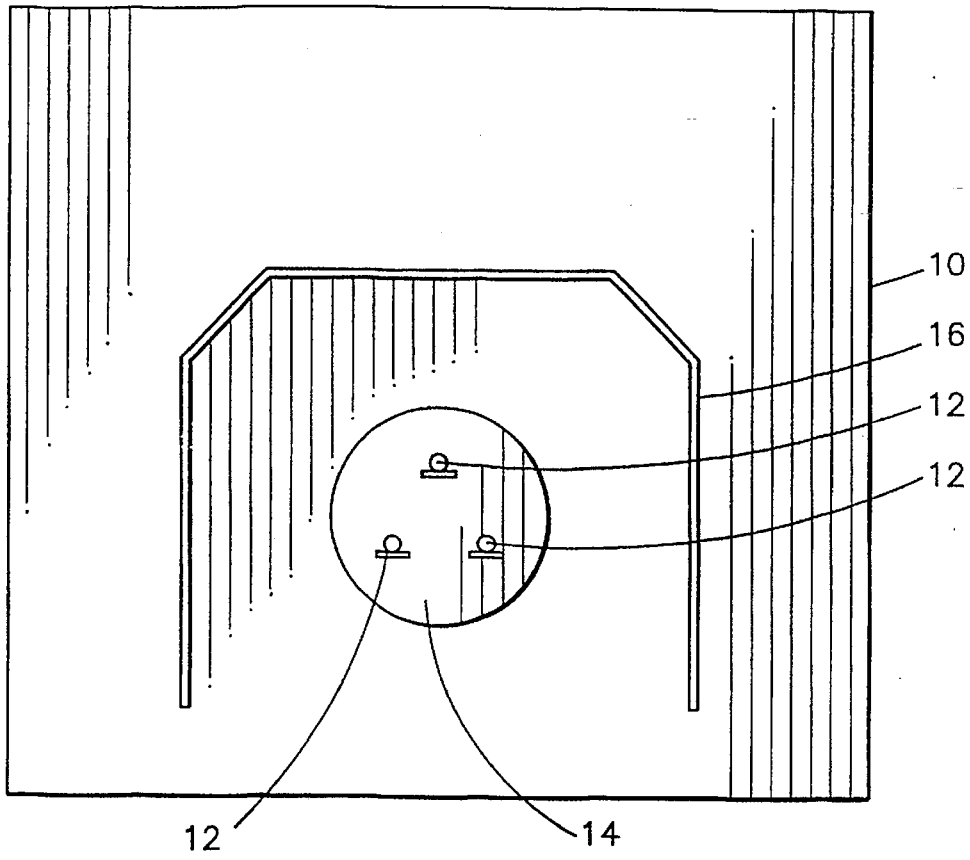
FIG. 1 (PRIOR ART)
FIG. 1 is an elevation view of a portion of an air conditioning system compressor showing the electrical power terminals.
Figure 2:
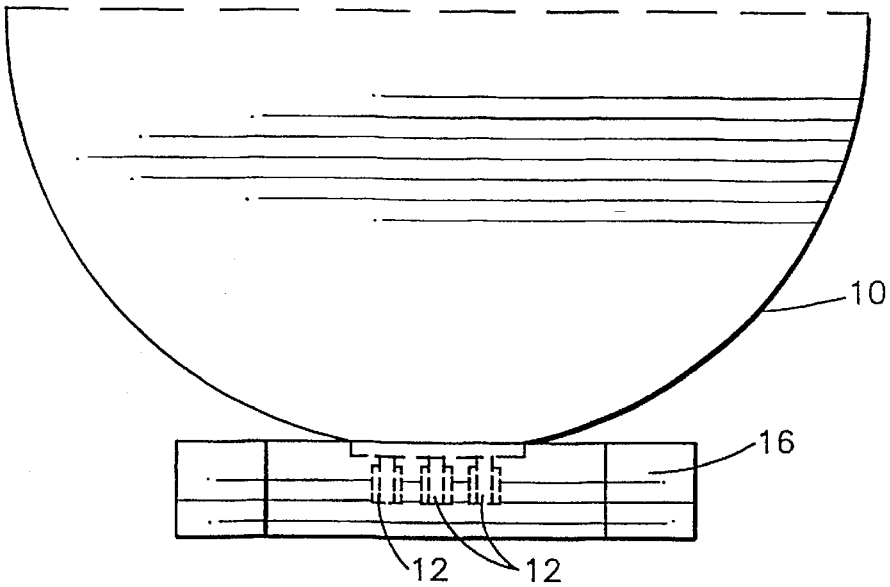
FIG. 2 (PRIOR ART)
FIG. 2 is a plan view of the portion of the compressor of FIG. 1 including the power terminals.
Figure 3:
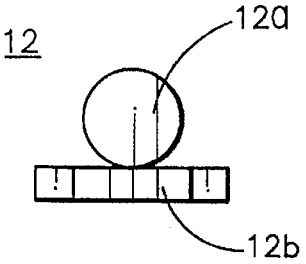
FIG. 3 (PRIOR ART)
FIG. 3 is an end view of a conventional electrical terminal.
Figure 4:
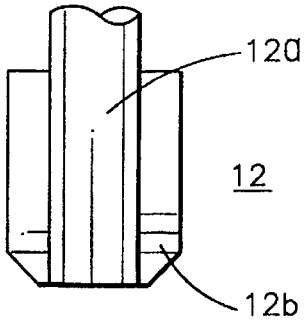
FIG. 4 (PRIOR ART)
FIG. 4 is a top view of the terminal of FIG. 3.

Referring now to the drawings in general and in particular to FIGS. 1 and 2, there is shown a side elevation view and a top plan view respectively of a portion of an air conditioning compressor system which illustrates in particular the electrical power connection terminals to the hermetically sealed motor within the compressor. The compressor and its integral motor are illustrated generally at 10 with the electrical terminals 12 extending outward of the compressor through an encapsulated block 14. The block 14 is typically a plastic material which is poured around the electrical connections and their associated wiring during manufacturing of the compressor assembly and serves to prevent moisture or other contaminants from entering into the compressor system and at the same time prevents any leakage of freon or other coolant from the compressor. Typically, a partial metal enclosure 16 is attached to the outer compressor housing and at least partially circumscribes the electrical connections 12 to both provide some degree of protection of the terminals 12 and to prevent accidental encounter with the terminals by persons working around the compressor. As can be seen in both the elevation view of FIG. 1 and the plan view of FIG. 2, the terminals 12 each comprise a solid cylindrical rod **12*a* with a flat plate-like portion 12*b* welded or braised to the rod 12*a*. The rod 12*a* passes into the encapsulated material 14 and connects internally of the compressor 10 to the electrical wiring of the motor driving the compressor. The flat plate-like members 12*b* provide a spade type electrical connector for a slip-on connector of the type well known in the art. An enlarged view of the member 12*a* and the plate-like member 12*b* is shown in an end view in FIG. 31 and in a top plan view in FIG. 4**.

When the compressor assembly is new, the plate **12*b* provides a fully adequate mechanism for connecting electrical power to the terminals 12. However, as the terminals are exposed to weather, vibration from running, starting and stopping of the compressor, and disconnection of the power terminals during servicing, the plate member 12*b* tends to wear or corrode and eventually may erode to the extent that it is no longer possible to connect the conventional connector to the terminals 12. In some instances, the member 12*b* may actually break away or separate from the cylindrical rod 12*a*. In general, it is not possible to replace the plate-like member 12*b* once it has been eroded or broken away from the rod 12*a*. If one were to attempt to weld or braise a new member 12*b* to the rod 12*a*, the temperature of the member 12*a* would be raised and would likely damage the seal created by the encapsulation material 14. In such instance, the compressor itself would then have to be replaced. However, it is not unknown for air conditioning technicians to replace the compressor assembly in those situations in which the plate-like member 12b has eroded or been broken away from the rod 12a since there is no convenient method for attaching an electrical lead to the short rod 12a**.

Figure 5:
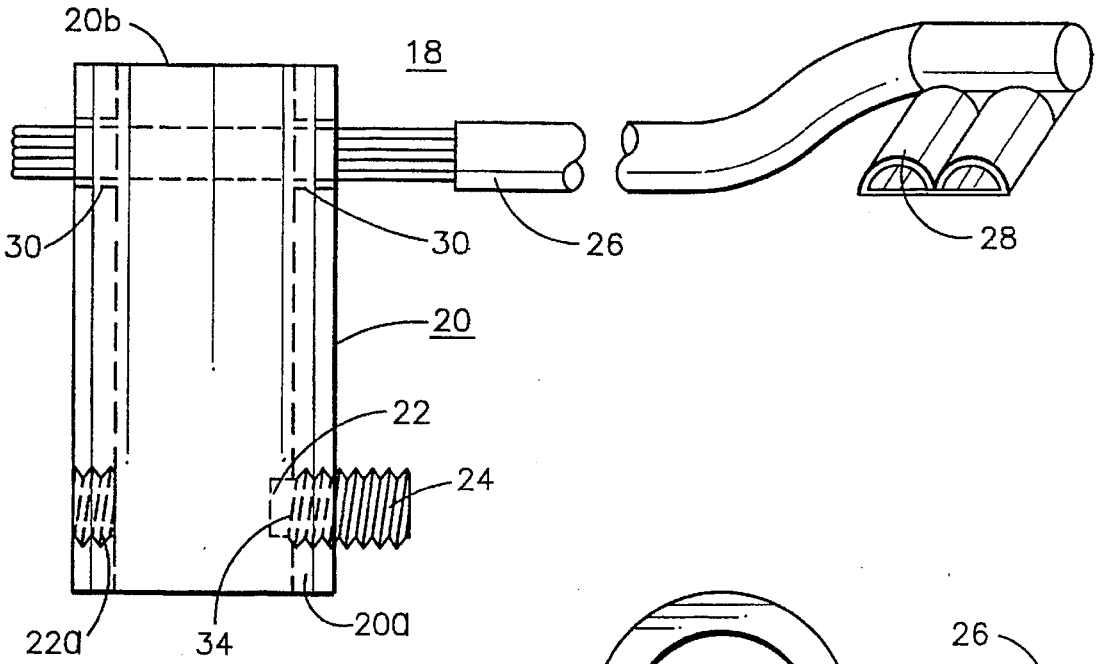
FIG. 5 illustrates a connector in accordance with the present invention.
Figure 6:
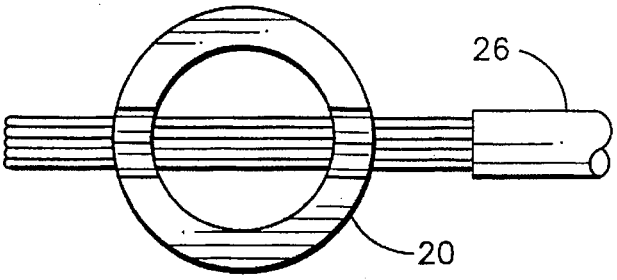
FIG. 6 is an end view of the connector of FIG. 5.
Figure 7:
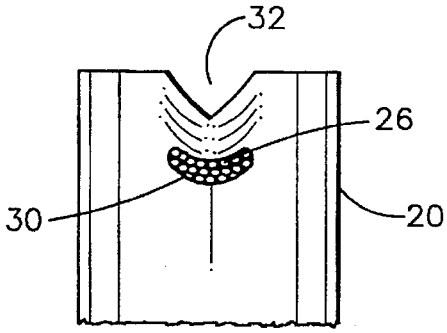
FIG. 7 is a partial side view of the connector of FIG. 5 showing crimping of an electrical cable.

Referring now to FIGS. 5, 6 and 7, there is shown an electrical connector adaptor in accordance with the present invention which enables an electrical connection to be made to the rod 12a without use of the flat plate-like member 12b. The connector assembly 18 of the present invention includes a tubular member 20 preferably formed of brass tubing having about a ¼ inch internal diameter and about a 12/32 inch outside diameter thus providing white wall thickness of about 1/16 inch. Adjacent a first end 20a of the tube 20, there is formed a threaded aperture 22 sized to receive a conventional 10/32 stainless steel set screw 24. The tube 20 is preferably about one inch in length and the threaded aperture 22 may be between 1/16 and ¼ inch from the end 20a of tube 20. As is indicated, the tube 20 may be also provided with a second aperture 22a at another location adjacent the tube end 20a. The second aperture can be used as a backup in the event that the threads in the first aperture 22 are stripped by overtightening of the set screw 24.

At a second end 20b of the tube 20, a pair of holes are drilled through the tube with a size sufficient to pass a length of No. 12 AWG wire. Such holes may be approximately ⅛ inch in diameter. The selected wire is typically a tin coated copper 65 strand wire indicated at 26. An opposite end of this wire is fitted with a female connector of the type which would normally connect to a spade type connector of the type shown at 12. As shown in FIG. 6, the stripped end of the cable 26 passes through the tube 20 passing through each of the holes 30 on opposite sides of the tube. The cable 26 may be maintained in mechanical and electrical connection to the tube 20 by soldering the cable 26 to the tube at each of the holes 30 or, in a preferred manner, by forming a crimp in the top surface of the tube to compress the malleable brass material against the wires of the cable 26. Referring to FIG. 7, there is shown a side view with a crimp 32 formed in the top end of the tube 20 such that the crimp compresses the material between the top of the tube and the hole 30 so as to permanently fasten the wire 26 to the tube 20.

In operation, the plate 12b on each of the electrical terminals 12 may be removed to the extent necessary to allow the tube 20 to fit over the terminal 12 whereby the tube 20 can then be mechanically and electrically connected to the rod 12a by tightening of set screw 24. Conventionally, the end of the set screw 24 which contacts the rod 12a is formed with a sharpened edge which tends to bite into the material of the rod 12a and thus prevents loosening of the set screw. Once the tube 20 has been placed over the electrical terminal 12 and the set screw 24 tightened, the cable 26 may be used to replace the existing cables connecting electrical power to the compressor 10.

While the inventions has been described in what is presently considered to be a preferred embodiment, various modifications and improvements will become apparent to those skilled in the art. It is intended therefore that the invention not be limited to the specific disclosed embodiment but be interpreted within the full spirit and scope of the appended claims.

What is claimed is:

1. An electric power connection system for coupling electric power to an electric power terminal substantially encapsulated in an electrically insulative block whereby said terminal protrudes from a surface of said block, said connection system comprising:

a generally cylindrical tube of electrically conductive metallic material having at least one end with an inner diameter sized to admit said terminal in general sliding engagement within said tube, said tube further having a threaded aperture extending through a sidewall thereof adjacent said at least one end;

a set screw threadedly inserted in the threaded aperture and adapted for compressive engagement with said terminal for establishing retention and electrical continuity between said terminal and said tube;

an electrical lead connected to an end of said tube opposite said at least one end for coupling power to said terminal; and at least one aperture passing through said sidewall of said tube adjacent said opposite end, said electrical lead extending through said at least one aperture.

2. The system of claim 1 wherein said electrical lead is soldered to said tube.

3. The system of claim 1 and including a second aperture circumferentially aligned with said at least one aperture and passing through said side wall at said opposite end of said tube transverse to a longitudinal axis thereof, said electrical lead being inserted through both said apertures.

4. The system of claim 3 wherein said opposite end of said tube is punched toward said one end thereof over each of said apertures to thereby crimp said apertures onto said lead.

5. In an electrical power system of the type including an alternating current electric motor having a plurality of electric power terminals substantially encapsulated in a plastic molded block with ends of the terminals extended outward of the block, the improvement comprising:

a generally cylindrical tube of electrically conductive metallic material having at least one end with an inner diameter sized to admit one of said terminals in general sliding engagement with said tube, said tube further having a threaded aperture extending through a sidewall thereof adjacent said at lease one end;

a set screw threadedly inserted in the threaded aperture and adapted for compressive engagement with said terminal for establishing retention and electrical continuity between said terminal and said tube;

at least one pair of circumferentially aligned apertures passing through an opposite end of said tube transverse to a longitudinal axis thereof; and an electrical lead inserted through said apertures of said tube opposite said at least one end for coupling power to said terminal.

6. The improvement of claim 5 wherein said electrical lead is soldered to said tube.

7. The improvement of claim 5 wherein said electrical lead is connected to said tube by crimping said opposite end of said tube onto said lead.

8. The improvement of claim 7 wherein said opposite end of said tube is punched toward said one end thereof over each of said apertures to thereby crimp said apertures onto said lead.

9. A method for connecting electrical power to an electric power system in which the system incorporates stub-like terminals extending outwardly of an electrical terminal block, each of the terminals including a flat plate attached thereto for forming a spade-type connector, the method comprising the steps of:

substantially removing the flat plate from each of the terminals;

providing for each of the terminals a tubular metal connector having an inside diameter larger than an outside diameter of each of the terminals, each connector including a set screw extending through a threaded aperture adjacent one end of the connector and an electrical lead attached to another end of the connector;

inserting each connector over a respective one of the terminals and tightening the set screws to mechanically and electrically couple the connectors to the terminals; and connecting the electrical leads to a source of electric power for energizing the system.

10. The method of claim 9 and including the further step of attaching the electrical lead to the connector by crimping the another end of the connector onto the lead.

11. The method of claim 9 and including the steps of drilling a hole through the another end of the connector transverse to a longitudinal axis thereof, inserting an end of the electrical lead through the hole in the connector and crimping the another end of the connector onto the lead.

12. The method of claim 11 wherein the step of crimping comprises the step of punching a rim of the another end of the connector above the hole so as to collapse the hole onto the lead.

* * * * *